US005207283A

United States Patent [19]

Lay

[11] Patent Number: 5,207,283

[45] Date of Patent: May 4, 1993

[54] REVERSIBLE BIT BEARING

[75] Inventor: Warren T. Lay, Roanoke, Va.

[73] Assignee: Ingersoll-Rand Company, Woodcliff Lake, N.J.

[21] Appl. No.: 844,046

[22] Filed: Mar. 2, 1992

[51] Int. Cl.[5] ..... E21B 4/14

[52] U.S. Cl. ..... 175/296; 175/417

[58] Field of Search ..... 175/320, 321, 417, 418, 175/298, 297

[56] References Cited

U.S. PATENT DOCUMENTS

| | | | |
|---|---|---|---|
| 4,025,133 | 5/1977 | Coinford | 384/310 |
| 4,103,979 | 8/1978 | Kuhn | 384/306 X |
| 4,553,857 | 11/1985 | Ney | 384/293 X |
| 5,115,875 | 5/1992 | Ennis | 175/296 X |

*Primary Examiner*—William P. Neuder

*Attorney, Agent, or Firm*—John J. Selko

[57] ABSTRACT

A fluid-activated, percussive, down-the-hole drill having a reversible bearing and bit combination for altering the volume of return reservoir exhaust fluid between a larger amount for deep hole drilling and a smaller amount for shallow hole drilling.

11 Claims, 3 Drawing Sheets

REVERSIBLE BIT BEARING

BACKGROUND OF THE INVENTION

This invention relates generally to fluid-activated, percussive, down-the-hole drills, and more particularly to such drills that use compressed air as the percussive fluid for removal of debris from the drillhole, after the compressed air actuates the drill and is exhausted out the drill.

Percussive drills of this type comprise a hollow cylindrical drill casing; a chuck connected to a bottom end of the drill casing; a drill bit connected to the chuck; a back head assembly fluidly connecting the drill to a drill string; a piston slidably mounted within the drill casing for reciprocating between an impact position in contact with the drill bit and a return position not in contact with the drill bit; drive chamber fluid passageway means for providing a first reservoir of percussive fluid for reciprocating the piston between the return position and the impact position; return chamber fluid passageway means for providing a second reservoir of percussive fluid when the piston is in the return position, for exhausting from the drill; and exhaust fluid passageway means for conducting the percussive fluid from the return chamber fluid passageway through the drill to an exhaust port, to lift debris up a drillhole.

For shallow hole drilling, that is for depths less than about 600 feet, a conventional volume of compressed air that is exhausted at the completion of each cycle of the piston is sufficient to lift the air column and debris in the drillhole. However, for deep hole drilling, that is for depths above 600 feet, a greater amount of compressed air must be expelled by the drill for each cycle of the piston, due to the increased weight of air and debris in the drillhole.

In order to increase the volume of compressed air used for each stroke of the piston, it is possible to increase either the volume of the drive chamber or the volume of the return chamber, or both. The drive chamber volume is dictated by the diameters of the drill casing, the piston and by the piston's stroke length, and changing these parameters is difficult, without rebuilding the drill. This leaves the return chamber volume for adjustment. Prior art adjustment of the return chamber volume for deep hole and shallow hole drilling is achieved by inserting a different bearing between the drill casing and the drill bit, for each volume of return chamber desired.

This requires special bearings for each application, and can lead to confusion by the operator as to which bearing is to be used for a specific application.

The foregoing illustrates limitations known to exist in present percussive down-the-hole drills. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention this is accomplished by providing a fluid-activated, percussive, down-the-hole drill, having a hollow cylindrical drill casing; a chuck connected to a bottom end of the drill casing; a drill bit connected to the chuck; a back head assembly fluidly connecting the drill to a drill string; a piston slidably mounted within the drill casing for reciprocating between an impact position in contact with the drill bit and a return position not in contact with the drill bit; drive chamber fluid passageway means for providing a first reservoir of percussive fluid for reciprocating the piston between the return position and the impact position; return chamber fluid passageway means for providing a second reservoir of percussive fluid, for exhausting from the drill; and exhaust fluid passageway means for conducting the percussive fluid through the drill to an exhaust port, to lift debris up a drillhole, in combination with a reversible bearing means between the drill casing and the drill bit, for varying the volume of said return chamber reservoir between a larger preselected amount, for deep drilling, and a smaller preselected amount, for shallow drilling.

The foregoing and other aspects will become apparent from the following detailed description of the invention when considered in conjunction with the accompanying figures.

BRIEF DESCRIPTION OF THE DRAWING FIGURES

DETAILED DESCRIPTION

Figure 1:
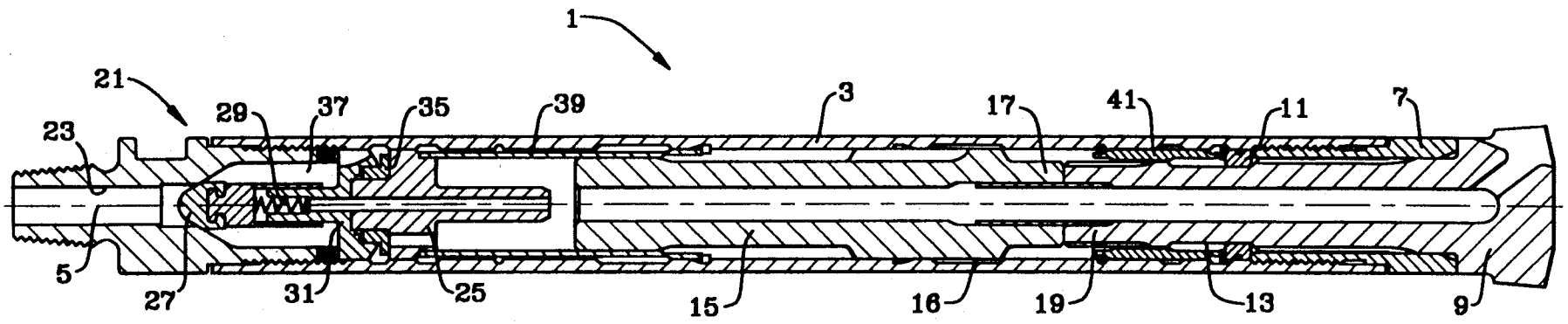
FIG. 1 is a schematic cross-sectional elevation of a down-the-hole drill with the bearing and bit of the invention positioned for shallow hole drilling, and the piston in the impact position.

FIG. 1 shows a drill 1 of the invention positioned for shallow drilling. The air inlet, exhaust and reciprocating piston elements of the drill are conventional, but will be described for clarity. Drill 1 comprises a hollow cylindrical drill casing 3, having a central axis 5 along it length. Chuck 7 is threadably connected to bottom end of drill casing 3. Drill bit 9 extends axially within chuck 7, and is held in place by retaining ring 11, that extends into an undercut 13 in the external surface of bit 9, as is conventional. Piston 15 slidably reciprocates in drill casing 3 between an impact position, shown in FIG. 1, and a return position, shown in FIG. 2. In the impact position, anvil 17 of piston 15 contacts a top end 19 of bit 9. Piston 15 has a machined land 16 extending circumferentially around its external surface to provide a seal with inner surface of drill casing 3, when piston 15 is in the return position, as hereinafter described.

Figure 2:
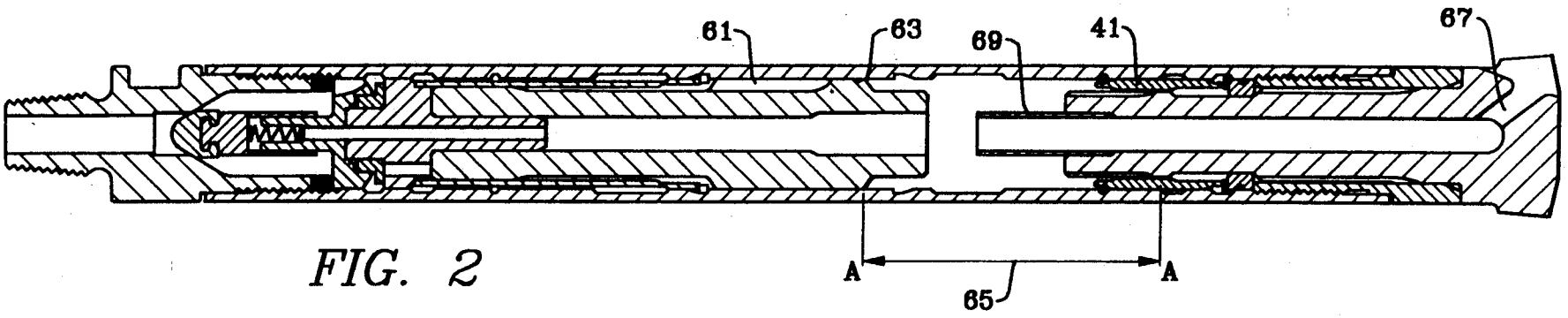
FIG. 2 is a schematic cross-sectional elevation of a down-the-hole drill with the bearing and bit of the invention positioned for shallow hole drilling, and the piston in the return position.
Figure 3:
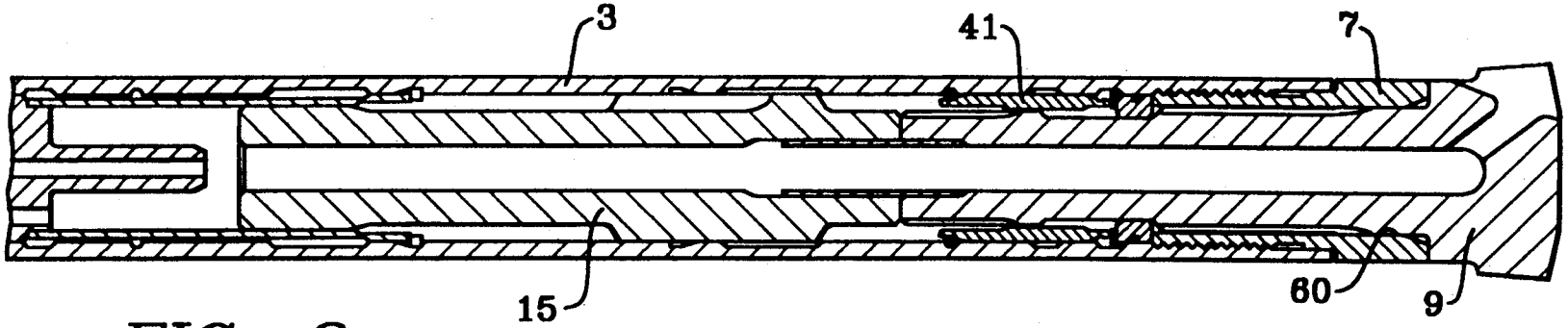
FIG. 3 is a schematic cross-sectional elevation of a down-the-hole drill, with parts of the backhead assembly removed, with the bearing and bit of the invention positioned for deep hole drilling, and the piston in the impact position.

As shown in FIGS. 1 and 2, conventional backhead assembly, shown generally as 21, fluidly connects the drill 1 to a drill string (not shown) that carries percussive fluid (compressed air) to drill 1 and eventually through bore 23 of drill 1. Backhead assembly 21 is conventional, but will be described for clarity.

Backhead assembly 21 includes a conventional distributor 25, having appropriate ports (not shown) for passage of compressed air therethrough. Distributor 25 is provided with a check valve 27 that serves to prevent a reverse flow of pressure and fluid into the drill 1 from the drillhole, when the drill 1 is not in use. Spring 29 serves to bias check valve 27 towards a closed position in contact with bore 23, when there is no compressed air moving through the drill. Valve cap 31 and valve 35 have fluid passageways that permit air inlet chamber 37 to fluidly communicate with a fluid passageway that extends downwardly along the length of drill 1. Such passageway is in part formed by the annular space between a wear cylinder 39 and drill casing 3 (FIG. 1). Such passageway is referred to herein as the drive chamber fluid passageway, and its purpose is to reciprocate piston 15 in the drill. The drive chamber fluid passageway is the same for both deep hole and shallow hole drilling, and is not part of this invention. Any conventional arrangement of passageways to drive piston 15 will suffice.

Figure 6:
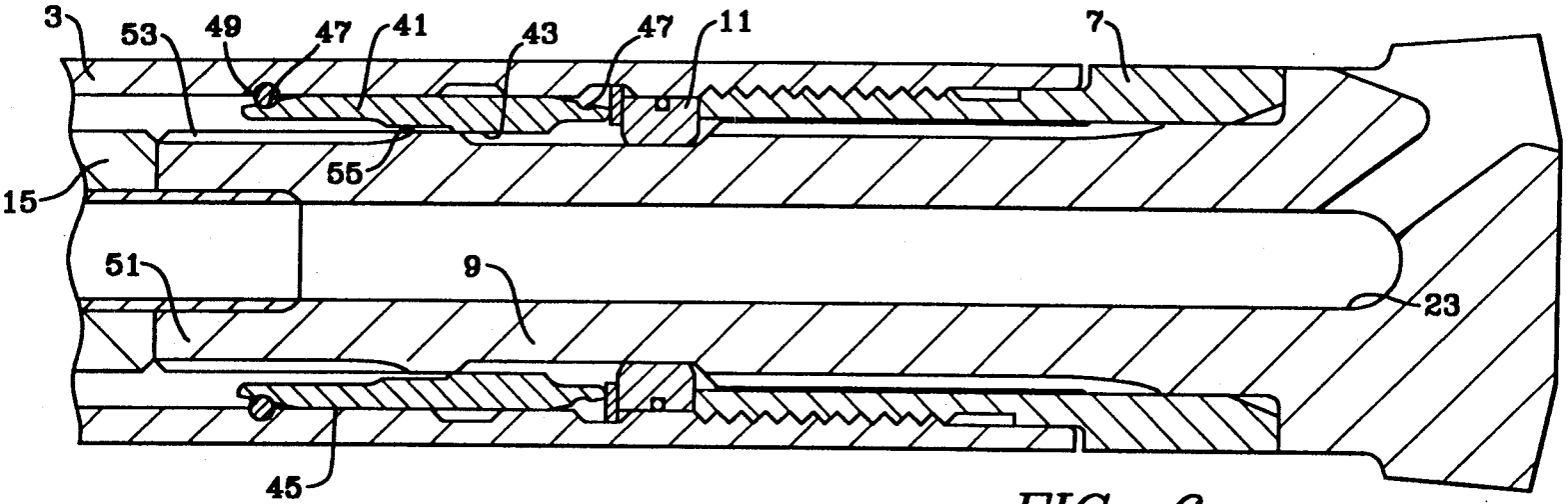
FIG. 6 is a schematic cross-sectional elevation of an expanded view of the bearing and bit portion of the invention, with the bearing positioned for shallow hole drilling and the piston in the impact position.

As shown in FIG. 6, between drill bit 9 and drill casing 3 is the reversible bearing 41 of this invention. Bearing 41 is a hollow cylinder concentrically spaced around bit 9. Bearing 41 has an internal surface spaced from the bit 9, and a machined land portion 43 protruding inwardly toward bit 9. Land portion 43 extends circumferentially around the entire inner surface of the cylinder forming bearing 41.

Figure 5:
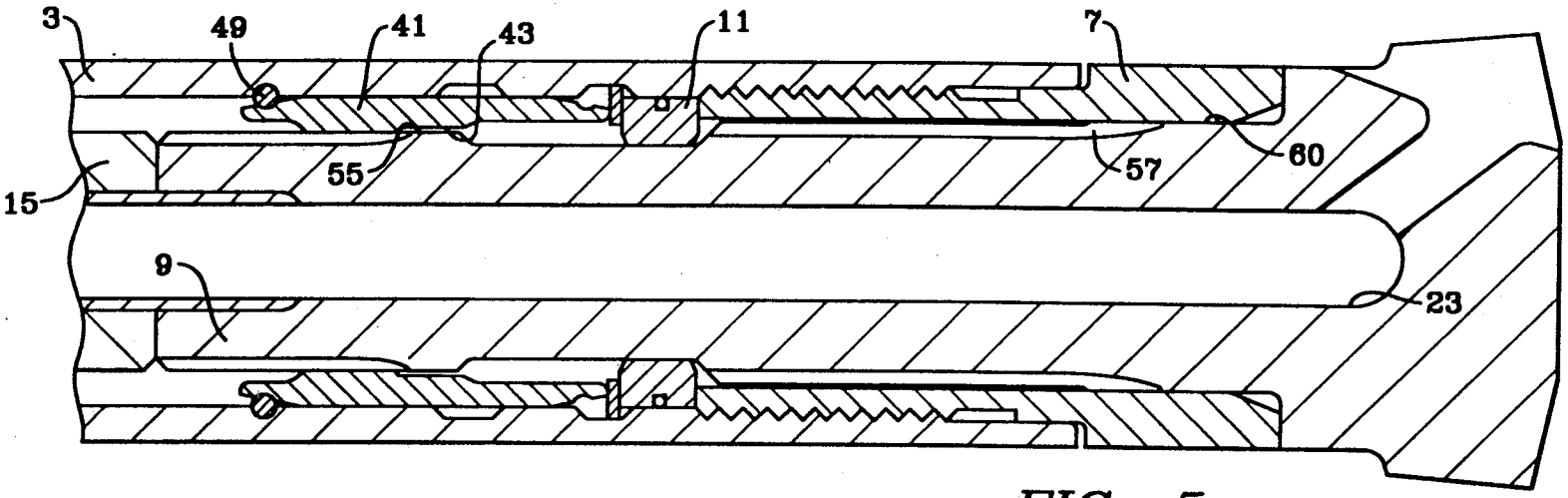
FIG. 5 is a schematic cross-sectional elevation of an expanded view of the bearing and bit portion of the invention, with the bearing positioned for deep hole drilling, and the piston in the impact position.

Bearing 41 has an external surface 45 in contact with drill casing 3 to align the bearing 41 precisely along axis 5. I prefer a plurality (preferably two) of circumferentially extending machined land portions 45, although a single, broad, land portion 45 will work. Bearing 41 has an undercut portion 47 on its external surface adjacent both a top and bottom end. Undercut surface 47 is adapted to receive a fluid retaining seal 49 between bearing 41 and drill casing 3, when bearing 41 is in either the shallow drilling mode, or in the reverse deep drilling mode, as described hereinafter, and as shown in FIG. 5.

Drill bit top end 51 (FIG. 6) has a plurality of longitudinally extending splines 53 spaced around the circumference of its external surface, as is well known. Splines 53 terminate in a machined land portion 55 protruding towards drill casing 3. Land 43 of bearing 41 and land 55 of bit 9 make sealing contact with each other, when the bearing 41 is positioned for shallow drilling. The effect of such sealing contact is to define the bottom extent of the return chamber fluid passageway means.

Referring to FIG. 2, piston 15 has a plurality of scallops 61 spaced circumferentially around its external surface, extending downwardly. Scallops 61 terminate in machined land 63 that extends circumferentially around external surface of piston 15 Land 63 makes sealing contact with the inner surface of drill casing 3, when piston 15 is in the return position. The effect of such sealing contact is to define the top extent of the return chamber fluid passageway means. Thus, it can be understood that there is provided a return chamber volume 65 of percussive fluid, by means of the sealing bottom contact made by lands 43 and 55 of the bearing and bit, respectively, and also by means of the top sealing contact of land 63 and drill casing 3. This return chamber volume extends between dotted lines A—A of FIG. 2.

In operation, this return chamber volume of percussive fluid is exhausted out bore 23 and exhaust port 67, when the inner surface of bore 23 of piston 15 loses contact with exhaust tube 69, as piston 15 moves toward its return position. This exhaust occurs about 1200 times per minute, and provides the volume of air that moves the debris up and out of the drillhole.

For deep hole drilling, it is necessary to provide a greater volume of air to be exhausted from the return chamber 65. This greater volume is provided by reversing, or inverting, the position of bearing 41, as is shown in FIG. 5. Land 43 of bearing 41 is spaced from land 55 of bit 9, to open a passageway to a greater length along bit 9. Bit 9 also has a plurality of longitudinally extending splines 57 spaced around the circumference of its external surface, and engaged with corresponding splines in chuck 7. The spacing between the splines of chuck 7 and splines 57 of bit 9, provide fluid passageways that terminate in a bottom sealing contact 60 with chuck 9.

Figure 4:
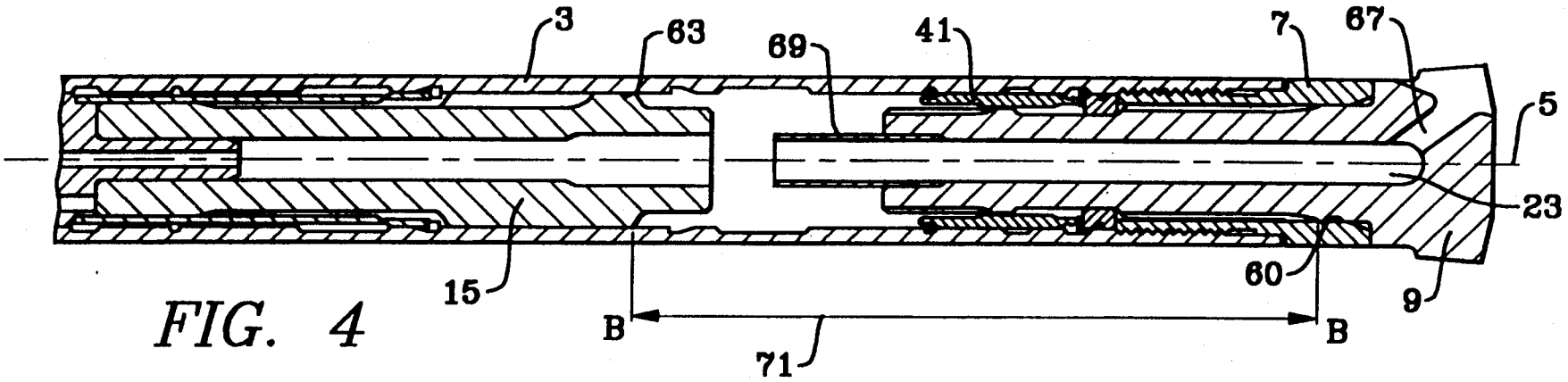
FIG. 4 is a schematic cross-sectional elevation of a down-the-hole drill, with parts of the backhead assembly removed, with the bearing and bit of the invention positioned for deep hole drilling, and the piston in the return position.

Thus, as shown in FIG. 4, there is provided a return chamber volume 71 of percussive fluid, by means of the sealing bottom contact 60 made by bit 9 and chuck 7, and also by means of the top sealing contact of land 63 and drill casing 3. This chamber volume extends between dotted lines B—B of FIG. 4. Thus, the deep hole return chamber volume provides a reservoir of percussive fluid that is larger than the reservoir provided for shallow hole drilling, as described hereinabove. With each cycle of piston 15, there is exhausted to the drillhole a larger amount of compressed air. Thus, the ability of the drill to move a higher column of air and debris is provided, with a single, reversible bit and bearing combination.

In practice, I have successfully provided a drill having a return chamber volume of about 7.5 cubic inches, for shallow drilling, and a return chamber volume of about 13.8 cubic inches, for deep hole drilling. Thus, the reversible bearing and bit combination of this invention has almost doubled the volume of exhaust air available from the return chamber for debris removal.

Having described the invention, what is claimed is:

1. In a fluid-activated, percussive, down-the-hole drill, having a hollow cylindrical drill casing; a chuck connected to a bottom end of the drill casing; a drill bit connected to the chuck; a back head assembly fluidly connecting the drill to a drill string; a piston slidably mounted within the drill casing for reciprocating between an impact position in contact with the drill bit and a return position not in contact with the drill bit; drive chamber fluid passageway means for providing a first reservoir of percussive fluid for reciprocating the piston between the return position and the impact position; return chamber fluid passageway means for providing a second reservoir of percussive fluid when the piston is in the return position, for exhausting from the drill; and exhaust fluid passageway means for conducting the percussive fluid from the return chamber fluid passageway means through the drill to an exhaust port, to lift debris up a drillhole, the improvement comprising:

(a) reversible bearing means between the drill casing and the drill bit, for varying the volume of said return chamber reservoir between a larger preselected amount, for deep drilling, and a smaller preselected amount, for shallow drilling.

2. The invention of claim 1, in which said reversible bearing means is removably inserted in the drill casing, and in combination with the drill casing, chuck, drill bit, and piston provides:

(a) in a first bearing position, a first preselected reservoir of percussive fluid in said return chamber, for deep drilling; and, (b) in a second, reverse bearing position, a second preselected reservoir of percussive fluid in said return chamber, for shallow drilling, said second reservoir of percussive fluid being smaller than said first reservoir of percussive fluid.

3. The invention of claim 2 in which said bearing means comprises:

(a) a hollow cylinder concentrically spaced around the drill bit;

(b) said bearing having an internal surface spaced from the drill bit and a land portion protruding inwardly toward the drill bit;

(c) said land portion, being spaced from said drill bit when said bearing is mounted in said first position; and (d) said land portion, being in sealing contact with said drill bit, when said bearing is mounted in said second, reverse position.

4. The invention of claim 3 in which said bearing has an external surface in sealing contact with the drill casing.

5. The invention of claim 4, in which said external bearing surface contains a plurality of circumferential land portions extending toward, and contacting an internal surface of the drill casing.

6. A reversible bearing for removable insertion in a fluid-activated, percussive, down-the-hole drill, having a hollow cylindrical drill casing; a chuck connected to a bottom end of the drill casing; a drill bit connected to the chuck; a back head assembly fluidly connecting the drill to a drill string; a piston slidably mounted within the drill casing for reciprocating between an impact position in contact with the drill bit and a return position not in contact with the drill bit, said bearing comprising:

(a) a hollow cylinder for concentric mounting around the drill bit;

(b) said bearing having an internal surface adapted to be spaced from the drill bit, with a land portion protruding inwardly toward the drill bit;

(b) said land portion adapted to be spaced from said drill bit when said bearing is mounted in said first position; and (c) said land portion adapted to be in sealing contact with said drill bit, when said bearing is mounted in said second, reverse position.

7. The invention of claim 6 in which said bearing has an external surface having an undercut portion adjacent a top and bottom end, adapted for retaining a fluid seal in contact with the drill casing.

8. The invention of claim 7, in which said external surface contains a plurality of circumferential land portions adapted to extend toward and contact an internal surface of the drill casing, to provide axial alignment of said bearing within said drill casing.

9. In a fluid-activated, percussive, down-the-hole drill, having a hollow cylindrical drill casing; a chuck connected to a bottom end of the drill casing; a drill bit connected to the chuck; a back head assembly fluidly connecting the drill to a drill string; a piston slidably mounted within the drill casing for reciprocating between an impact position in contact with the drill bit and a return position not in contact with the drill bit; drive chamber fluid passageway means for providing a first reservoir of percussive fluid for reciprocating the piston between the return position and the impact position; return chamber fluid passageway means for providing a second reservoir of percussive fluid when the piston is in the return position, for exhausting from the drill; and exhaust fluid passageway means for conducting the percussive fluid from the return chamber fluid passageway means through the drill to an exhaust port, to lift debris up a drillhole, the improvement comprising:

(a) reversible sealing means between the drill casing and the drill bit, for varying the volume of said return chamber reservoir between a larger preselected amount, for deep drilling, and a smaller preselected amount, for shallow drilling;

(b) said reversible sealing means comprising:

(i) an external land surface on the piston in sealing contact with the drill casing;

(ii) an external surface on the drill bit having a land portion protruding toward the drill casing;

(iii) a reversible bearing removably inserted in the drill casing;

(c) said bearing further comprising:

(i) a hollow cylinder concentrically spaced around the drill bit;

(ii) said bearing having an internal surface spaced from the drill bit and a land portion protruding inwardly toward the drill bit;

(iii) said bearing land portion, being spaced from said drill bit when said bearing is mounted in said first position; and (iv) said bearing land portion being in sealing contact with said drill bit land portion, when said bearing is mounted in said second, reverse position, (d) whereby, said bearing, in combination with the drill casing, chuck, drill bit, and piston provides:

(i) in a first bearing position, a first preselected reservoir of percussive fluid in said return chamber, for deep drilling; and, (ii) in a second, reverse bearing position, a second preselected reservoir of percussive fluid in said return chamber, for shallow drilling, said second reservoir of percussive fluid being smaller than said first reservoir of percussive fluid.

10. A bearing for reversible use in a down-the-hole-drill, comprising:

a) a hollow cylinder having an internal surface, and external surface, a top end and a bottom end;

b) an inwardly protruding circumferential sealing land portion on the internal surface between the top and bottom ends, said inwardly protruding sealing land being a first distance from the top end and a second distance from the bottom end, said first and second distances being different, whereby when the bearing is used in a first position in the drill, the sealing land is in a sealing position with respect to; a portion of the drill, and when the bearing is used in a second position in the drill, which is the reverse of the first position, the sealing land is out of the sealing position;

c) a first undercut portion on the external surface adjacent the top end;

d) a second undercut portion on the external surface adjacent the bottom end; and e) at least one circumferentially extending land portion on the external surface.

11. The bearing of claim 10, further including: another circumferentially extending land portion on the external surface adjacent the second undercut portion, the one circumferentially extending land portion being adjacent the first undercut portion.

* * * * *